US007909329B1

(12) United States Patent
Martinson

(10) Patent No.: US 7,909,329 B1
(45) Date of Patent: Mar. 22, 2011

(54) SLINGSHOT-LIKE SKILL GAME DEVICE AND METHOD

(76) Inventor: Lowell Martinson, Phoenix, AZ (US)

( * ) Notice: Subject to any disclaimer, the term of this patent is extended or adjusted under 35 U.S.C. 154(b) by 25 days.

(21) Appl. No.: 12/415,845

(22) Filed: Mar. 31, 2009

(51) Int. Cl.
*A63F 9/00* (2006.01)

(52) U.S. Cl. ..... 273/330; 273/329; 273/331; 273/333; 273/334; 273/398; 273/401

(58) Field of Classification Search ..... 273/329–331, 273/333–335, 348, 354, 398, 401, 402, 127 R
See application file for complete search history.

(56) References Cited

U.S. PATENT DOCUMENTS

| | | | | | |
|---|---|---|---|---|---|
| 110,792 | A | | 1/1871 | Schooley | |
| 270,141 | A | | 1/1883 | Snyder | |
| 430,155 | A | * | 6/1890 | Taylor | 473/507 |
| 622,663 | A | * | 4/1899 | Brighton | 273/335 |
| 883,860 | A | * | 4/1908 | Craven | 273/329 |
| 1,184,822 | A | | 5/1916 | Caplette, Jr. | |
| 1,559,953 | A | * | 11/1925 | Furman | 473/508 |
| 1,947,859 | A | | 2/1934 | Francis | |
| 2,131,550 | A | | 9/1938 | Collins | |
| 2,399,636 | A | * | 5/1946 | Johnson | 446/421 |
| 2,932,516 | A | | 4/1960 | Herbert | |
| 2,967,711 | A | * | 1/1961 | Anderson | 273/329 |
| 3,737,164 | A | | 6/1973 | De Yoe, Jr. | |
| D238,956 | S | * | 2/1976 | Evitt | D21/466 |
| 4,103,891 | A | | 8/1978 | Stefano | |
| 4,927,160 | A | * | 5/1990 | Nichol et al. | 273/371 |
| 5,249,810 | A | * | 10/1993 | Cazalet | 273/330 |
| 5,348,307 | A | | 9/1994 | Duggan | |
| 5,377,996 | A | | 1/1995 | Shure | |
| 5,722,662 | A | | 3/1998 | Howell | |
| 5,941,528 | A | | 8/1999 | Boivin, Jr. | |
| 7,641,199 | B1 | * | 1/2010 | Clarke | 273/330 |
| 2006/0261558 | A1 | * | 11/2006 | Bazinet | 273/330 |
| 2010/0140873 | A1 | * | 6/2010 | Britton et al. | 273/398 |

* cited by examiner

*Primary Examiner* — Raleigh W. Chiu
(74) *Attorney, Agent, or Firm* — Schmeiser, Olsen & Watts LLP

(57) ABSTRACT

A slingshot-like skill game device comprises a body and a handle attached to the body. The body includes an opening designed to permit a ball to pass therethrough. When the slingshot-like skill game device is outfitted with a ball attached thereto by an elongated elastic cord, a user may grasp the handle with one hand, grasp the ball with another hand, pull the ball away from the body, and then release the ball with the object of getting the ball to pass through the opening on release. A ring-shaped insert may be attached to the opening, so as to decrease the diameter of the opening and thereby increase the level of difficulty required for a user of the slingshot-like skill game device to get the ball to pass through the opening. Additional ring-shaped inserts of varying diameters may also be provided to further increase the level of difficulty for a user of the slingshot-like skill game device. The body may include one or more light sources that may be activated when a ball passes through the opening.

12 Claims, 7 Drawing Sheets

SLINGSHOT-LIKE SKILL GAME DEVICE AND METHOD

FIELD OF THE INVENTION

This invention relates generally to games of skill and, more particularly, to a slingshot-like skill game device and method which may aid a user thereof in developing and/or improving hand to eye coordination, and which may be used at various levels of skill.

BACKGROUND OF THE INVENTION

Games of skill have been around for ages. Games of skill are often used for such things as entertainment, amusement, contests, developing hand to eye coordination, and the like. Games of skill that may be used for improving hand to eye coordination are generally known in the prior art, such as ring toss, corn toss, horseshoes, and the like. Limitations exist with such prior art games of skill, in that they may be required to be played outdoors, may require a relatively large playing area, may require multiple sets of equipment and multiple participants, and the like. These limitations may present difficulties for users of such games of skill when, for various reasons, there is a desirability for play to take place indoors and/or in a relatively small space, or when the user wishes to play alone, for example.

A need therefore exists for a skill game device that may be used for improving hand to eye coordination, that may be played indoors, that does not require a relatively large playing area, and that does not require multiple sets of equipment and multiple participants.

The present invention satisfies these needs and provides other related advantages.

SUMMARY OF THE INVENTION

In accordance with an embodiment of the present invention, a slingshot-like skill game device is disclosed. The device comprises, in combination: a body having a front surface and a back surface; a handle coupled to the body; a ball; an elongated elastic cord having a first end and a second end, wherein the first end is adapted to be secured to the body and the second end is attached to the ball; an opening in the body adapted for the ball to pass therethrough; and a substantially ring-shaped insert adapted to be removably attached to the opening.

In accordance with another embodiment of the present invention, a slingshot-like skill game device is disclosed. The device comprises, in combination: a body having a front surface and a back surface; a handle coupled to the body; a ball; an elongated elastic cord having a first end and a second end, wherein the first end is adapted to be secured to the body and the second end is attached to the ball; a first opening in the body adapted for the ball to pass therethrough; a second opening in the body adapted for running the first end of the elongated elastic cord therethrough; a slot positioned on the back surface of the body, wherein the slot is adapted to receive the first end of the elongated elastic cord; and a substantially ring-shaped insert adapted to be removably attached to the first opening, wherein an interior diameter of the insert is slightly less than a diameter of the first opening.

In accordance with a further embodiment of the present invention, a method for playing a slingshot-like skill game is disclosed. The method comprises the steps of: providing a slingshot-like skill game device comprising, in combination: a body having a front surface and a back surface; a handle coupled to the body; a ball; an elongated elastic cord having a first end and a second end, wherein the first end is adapted to be secured to the body and the second end is attached to the ball; a first opening in the body adapted for the ball to pass therethrough; a second opening in the body adapted for running the first end of the elongated elastic cord therethrough; a slot positioned on the back surface of the body, wherein the slot is adapted to receive the first end of the elongated elastic cord; and a substantially ring-shaped insert adapted to be removably attached to the first opening, wherein an interior diameter of the insert is slightly less than a diameter of the first opening; securing the first end of the elongated elastic cord to the body; grasping the ball; pulling the ball away from the body; releasing the ball in an effort to get the ball to pass through the first opening; decreasing a diameter of the first opening by attaching the insert thereto; grasping the ball; pulling the ball away from the body; and releasing the ball in an effort to get the ball to pass through the insert.

DETAILED DESCRIPTION OF THE PREFERRED EMBODIMENTS

An embodiment of a slingshot-like skill game device 10 consistent with an embodiment of the present invention is shown in FIGS. 1-7. The slingshot-like skill game device 10 may be divided into the following principal components: a body 12 and a handle 14 coupled to the body 12. In this embodiment, the handle 14 is coupled to the body 12, such that the slingshot-like skill game device 10 comprises a one-piece assembly. It may be desired to fashion a slingshot-like skill game device 10 in which the body 12 and handle 14 comprise separate components which are then securedly coupled to one another in some manner. Preferably, the slingshot-like skill game device 10 is composed of a durable material such as plastic, but could also be composed of wood or some other desired material.

Figure 1:
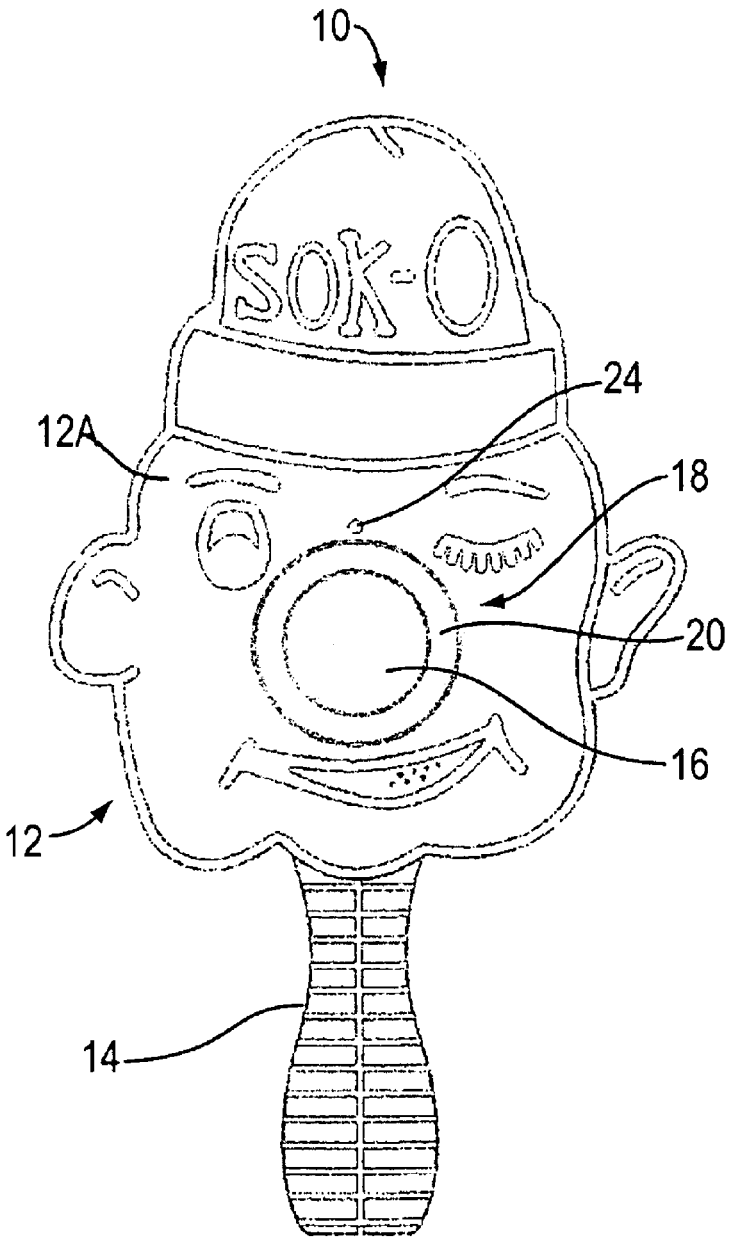
FIG. 1 is a front view of a slingshot-like skill game device, consistent with an embodiment of the present invention.
Figure 2:
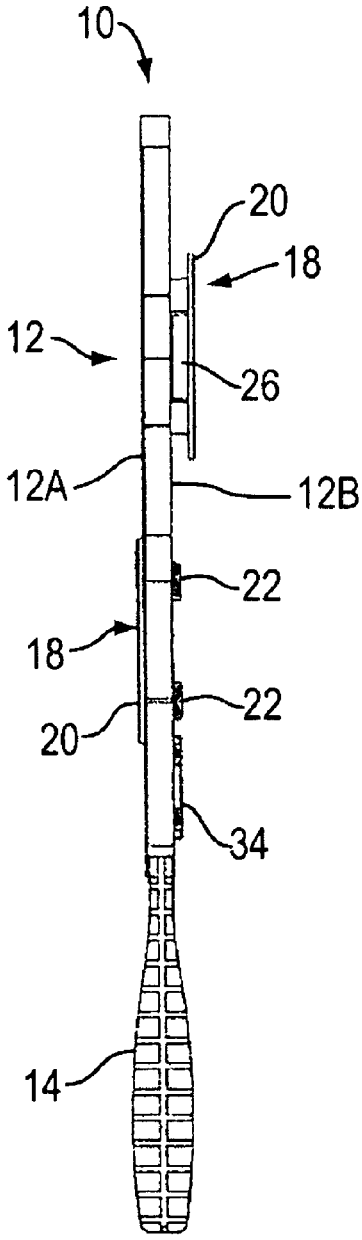
FIG. 2 is a side view of the device of FIG. 1.
Figure 3:
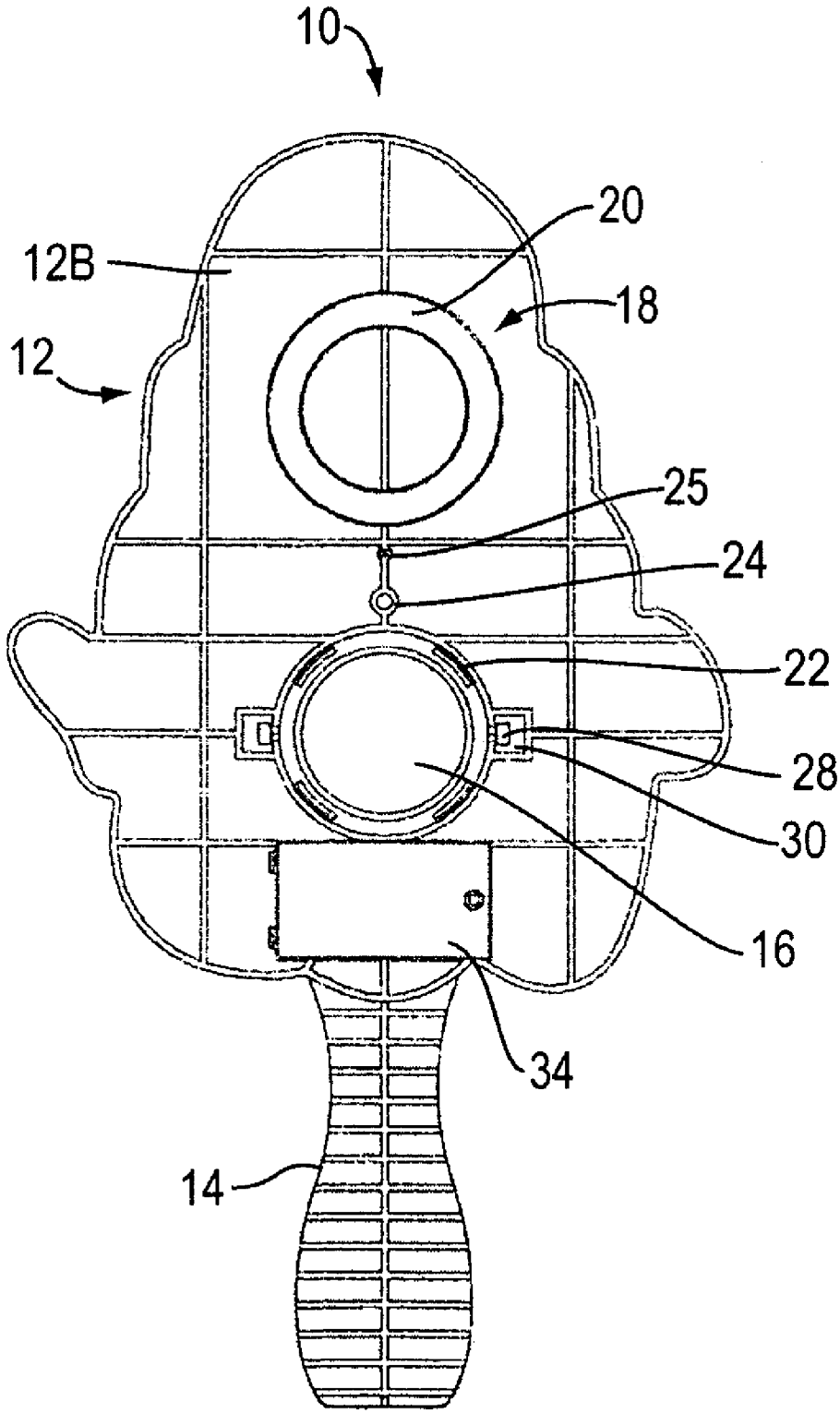
FIG. 3 is a back view of the device of FIG. 1.
Figure 4:
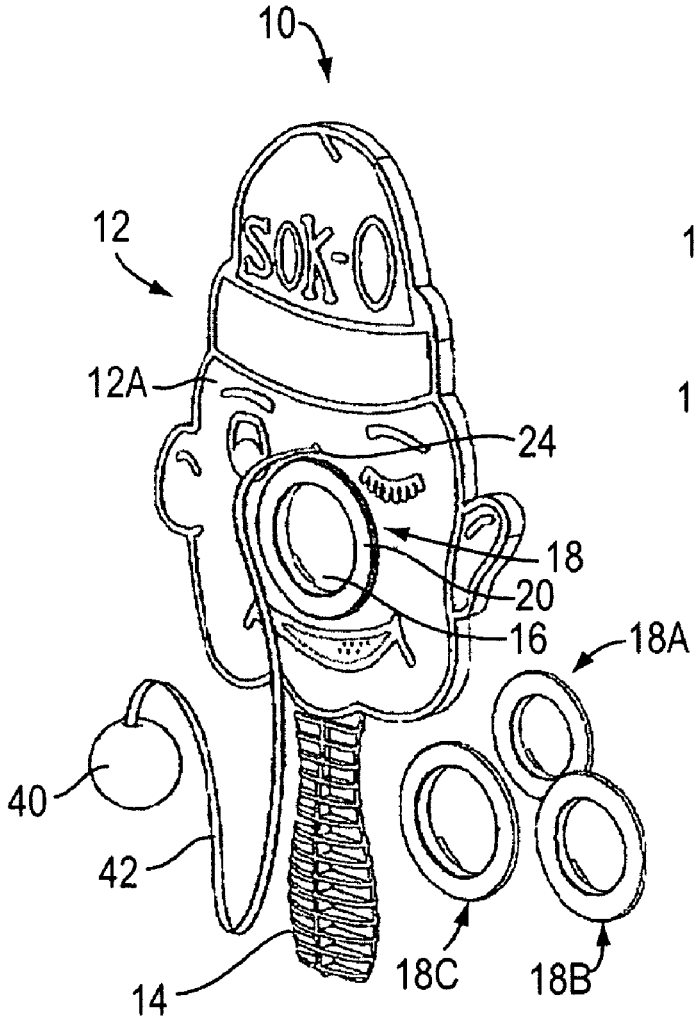
FIG. 4 is a front perspective view of the device of FIG. 1, illustrating an elastic cord and ball in position on the device, as well as a plurality of removable rings that may be used with the device.
Figure 5:
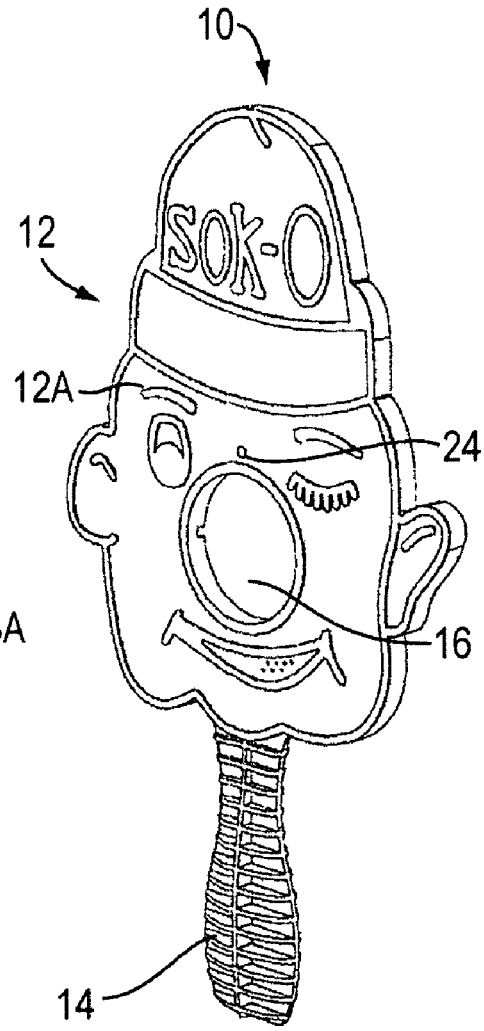
FIG. 5 is a front perspective view of the device of FIG. 1, illustrating an alternative configuration in which a removable ring of the device has been removed.
Figure 6:
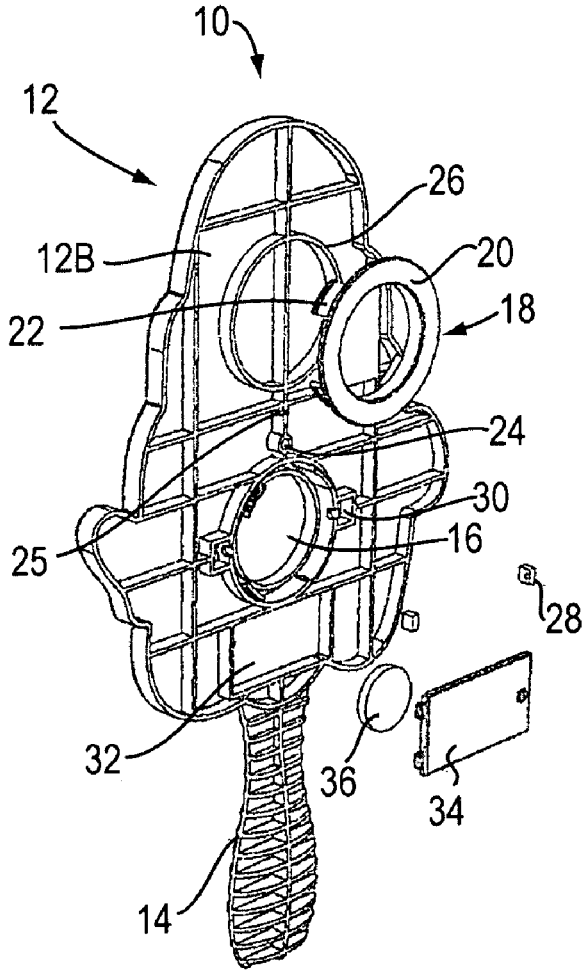
FIG. 6 is a back perspective, exploded view of the device of FIG. 1.
Figure 7:
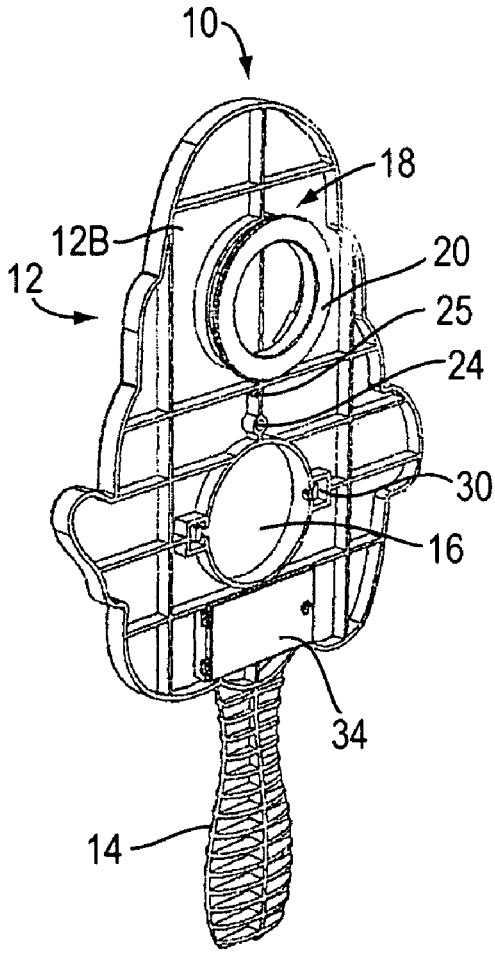
FIG. 7 is a back perspective view of the device of FIG. 1.
Figure 8:
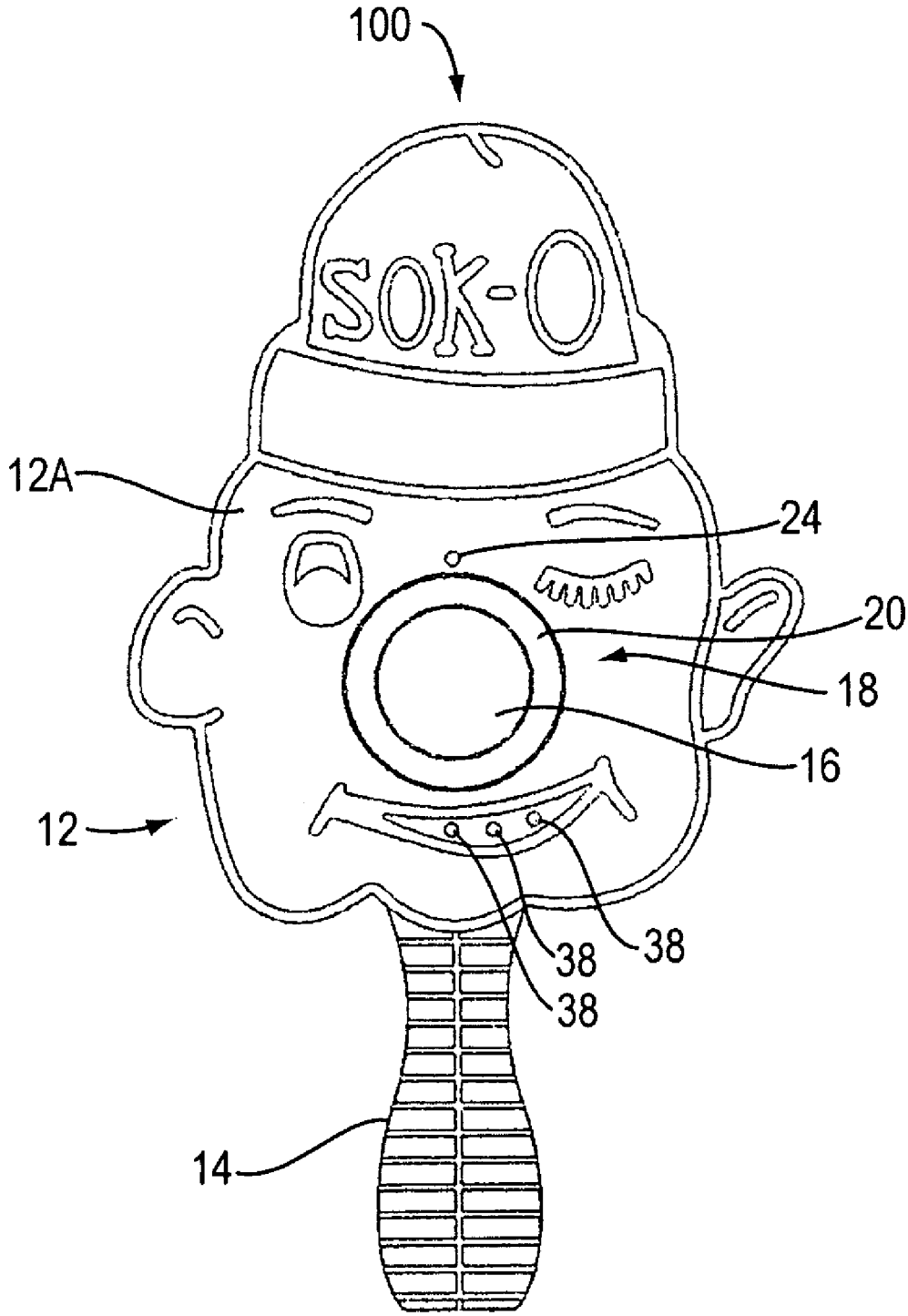
FIG. 8 is a front view of a slingshot-like skill game device, consistent with an embodiment of the present invention.
Figure 9:
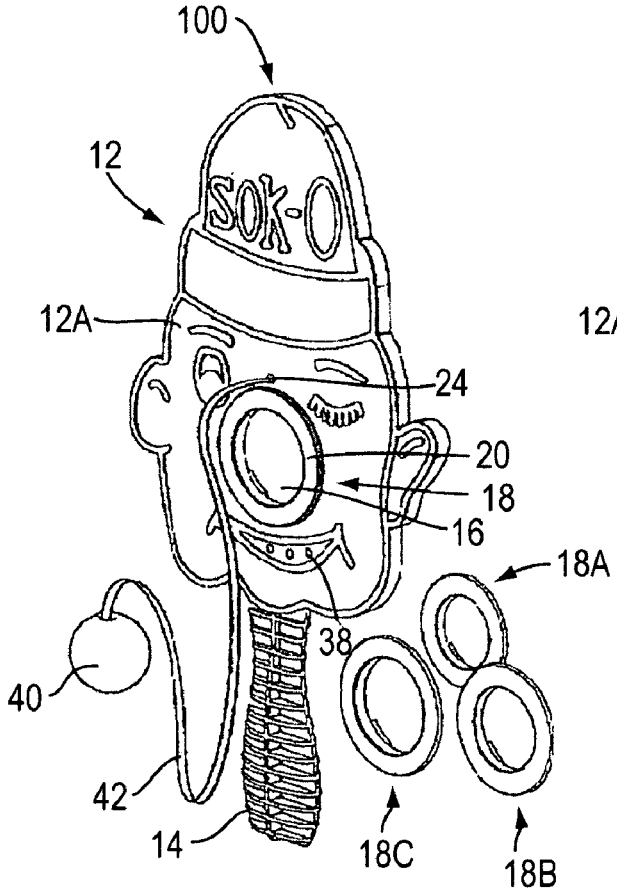
FIG. 9 is a front perspective view of the device of FIG. 8, illustrating an elastic cord and ball in position on the device, as well as a plurality of removable rings that may be used with the device.
Figure 10:
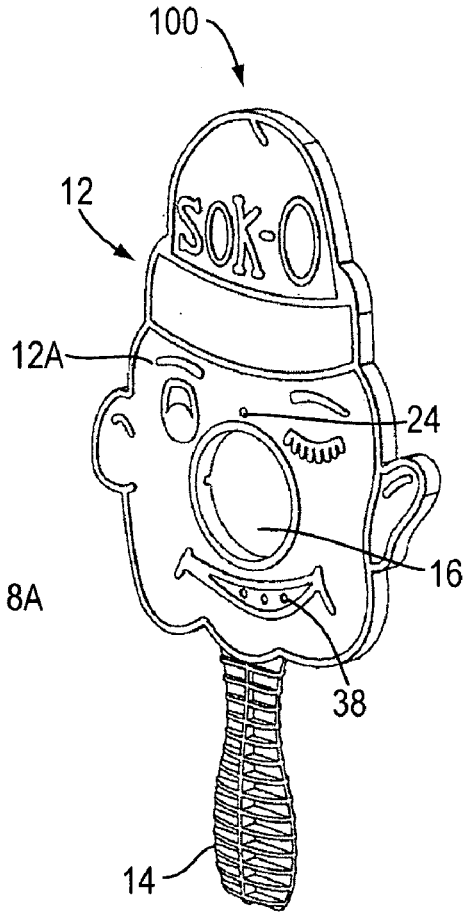
FIG. 10 is a front perspective view of the device of FIG. 8, illustrating an alternative configuration in which a removable ring of the device has been removed.
Figure 11:
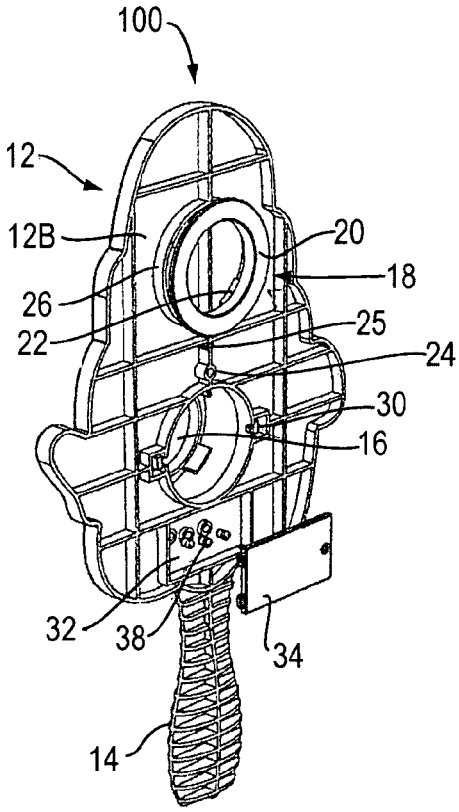
FIG. 11 is a back perspective, exploded view of the device of FIG. 8.
Figure 12:
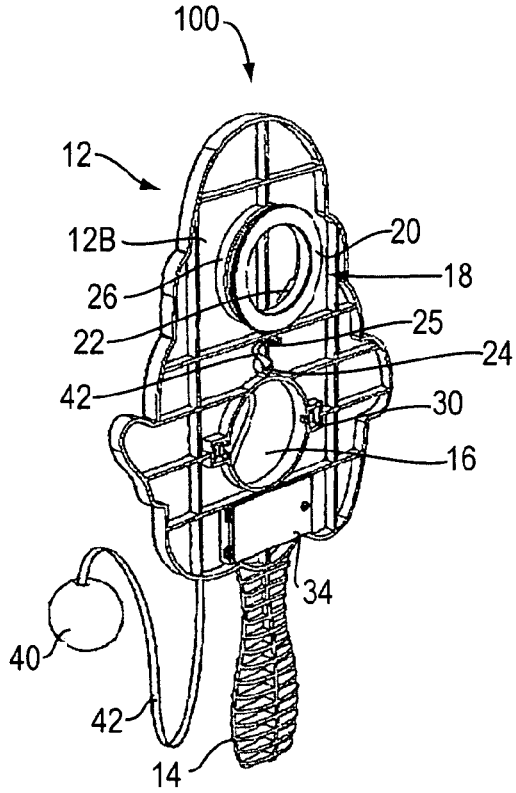
FIG. 12 is a back perspective view of the device of FIG. 8, illustrating an elastic cord and ball in position on the device.

In this embodiment, the body 12 comprises a front surface 12A (as best seen in FIGS. 1, 4 and 5) and a back surface 12B (as best seen in FIGS. 3, 6 and 7). The front surface 12A is preferably flat. While in this embodiment the body 12 has an overall shape resembling that of a head of a clown wearing a hat, the body 12 may be shaped in any number of other ways, as desired. For example, the body 12 may have an overall shape that is round, oval, square, etc. In this embodiment, the front surface 12A of the body 12 incorporates a clown face design, as best seen in FIGS. 1, 4 and 5. It may be desired for the body 12 to incorporate virtually any other design imaginable.

The body 12 further includes a first opening 16, as best illustrated in FIGS. 5 and 7. Preferably, the opening 16 is positioned substantially in a center of the body 12. The opening 16 preferably has a diameter that is greater than a diameter of a ball 40 (as shown in FIG. 4) with which the slingshot-like skill game device 10 is to be used, such that the ball 40 may pass through the opening 16 unobstructed. In particular embodiments, the ball 40 may have a diameter of one inch. The body 12 also includes a second opening 24. Preferably, the opening 24 is positioned slightly above the opening 16. In a preferred embodiment, the opening 24 has a relatively small diameter, but should be wide enough to permit a first end of an elongated elastic cord 42 (as shown in FIG. 4) to be positioned therethrough. In this way, the first end of the elongated elastic cord 42 may be positioned through opening 24 and then secured to the body 12 in some fashion, while a second end of the elongated elastic cord 42 may be attached to the ball 40 with which the slingshot-like skill game device 10 is to be used. Preferably, the back surface 12B of the body 12 includes a slot 25. Thus, in a preferred embodiment, securing the elongated elastic cord 42 to the body 12 may be accomplished by positioning the first end of the elongated elastic cord 42 through opening 24, grasping the elongated elastic cord 42, stretching the elongated elastic cord 42, inserting the first end of the elongated elastic cord 42 in slot 25, and then releasing the elongated elastic cord 42. Preferably, the elongated elastic cord 42 has a diameter of at least one-eighth of an inch. Further, according to particular embodiments of the present invention, the elastic cord may have a length of thirteen inches.

The slingshot-like skill game device 10 further comprises an insert 18, as seen in FIGS. 1-4 and 6-7. Preferably, the insert 18 comprises a ring 20 and a plurality of tabs 22 extending perpendicularly from the ring 20. The insert 18 is adapted to be positioned in opening 16 of the body 12. The tabs 22 may assist in allowing the insert 18 to snap into place after being positioned in opening 16, such that the insert 18 may be securedly coupled to the body 12. Preferably, the ring 20 of the insert 18 has an interior diameter that is slightly smaller than the diameter of opening 16, but that is greater than a diameter of the ball 40 with which the slingshot-like skill game device 10 is to be used, such that the ball 40 may pass through the opening 16, unobstructed, when the insert 18 is positioned on the body 12.

The object for a user of the slingshot-like skill game device 10 would be for the user to grasp the handle 14 with one hand, grasp the ball 40 with the user's other hand, pull the ball 40 away from the body 12, and then release the ball 40 in an attempt to get the ball 40 to pass through opening 16 upon release. Once the user has become proficient in getting the ball 40 to pass through opening 16 upon release, the user may desire to increase the level of difficulty required for this objective. In a preferred embodiment, the user may do so by positioning insert 18 on the body 12, such that the diameter of opening 16 is decreased. The user would then grasp the handle 14 with one hand, grasp the ball 40 with the user's other hand, pull the ball 40 away from the body 12, and then release the ball 40 in an attempt to get the ball 40 to pass through opening 16 upon release with insert 18 in place.

Once the user has become proficient in getting the ball 40 to pass through opening 16 upon release with insert 18 in place, the user may desire to further increase the level of difficulty required for this objective. In a preferred embodiment, the user may do so by positioning one of additional inserts 18A, 18B, and 18C on the body 12, such that the diameter of opening 16 is progressively further decreased. The user would then grasp the handle 14 with one hand, grasp the ball 40 with the user's other hand, pull the ball 40 away from the body 12, and then release the ball 40 in an attempt to get the ball 40 to pass through opening 16 upon release with one of inserts 18A, 18B, and 18C in place.

Turning now to FIGS. 6 and 7, the slingshot-like skill game device 10 further comprises an attachment ring 26. The attachment ring 26 preferably protrudes from the back surface 12B of the body 12 and is configured such that the insert 18 may be attached to the attachment ring 26 and thereby stored on the body 12 when not in use, as best seen in FIG. 7. While in this embodiment only one attachment ring 26 is shown, it may be desired to include more than one attachment ring 26 protruding from the back surface 12B of the body 12, such that additional inserts 18A, 18B, and 18C may be accommodated and stored when not in use.

In this embodiment, the slingshot-like skill game device 10 further includes compartments 30. Preferably, each of the compartments 30 is adapted to receive a light source 28, such as a light-emitting diode ("LED") or the like. In a preferred embodiment, the light source 28 may be coupled to a sensing means (not shown) so that when a user of the slingshot-like skill game device 10 is successful in getting the ball 40 to pass through opening 16, the light source 28 is activated. The sensing means may be, for example, photoelectric, light sensitive, or some other type of desired sensing means. In a preferred embodiment, activation of the light source 28 may be accomplished when the sensing means (not shown) reads a change in light conditions and/or a break in a sensor path, which may be caused by the ball 40 passing through opening 16. Preferably, the light source 28 then cycles through two to three seconds of backward and forward illumination, for example, and then returns to a standby mode wherein the light source 28 is not activated. The light source 28 may also cycle in a different manner: as desired. It may also be desired to provide means for the light source 28 to be activated throughout a duration in which the slingshot-like skill game device 10 is used. While two compartments 30 are shown in this embodiment, it may be desired for the slingshot-like skill game device 10 to have only one compartment 30, to have more than two compartments 30, or for the compartments 30 to be omitted.

The slingshot-like skill game device 10 may further include a compartment 32 with a door 34. In this embodiment, the compartment 32 is positioned on the back surface 12B of the body 12, proximate the opening 16. The compartment 32 may be positioned elsewhere on the body 12. It may also be desired to fashion a slingshot-like skill game device 10 in which the compartment 32 is omitted. The compartment 32 may be used for storing a battery 36 that may be used with the slingshot-like skill game device 10. For example, the battery 36 may be used to operate the light source 28. It may also be desired for the compartment 32 to store various other objects to be used with the slingshot-like skill game device 10, such as the elongated elastic cord 42, for example. Preferably, objects may be secured within the compartment 32 by snapping door 34 into place.

Referring now to FIGS. 8-12, an alternative embodiment of the slingshot-like skill game device 10, hereinafter 100, is shown. The slingshot-like skill game device 100 is essentially the same as the slingshot-like skill game device 10, except that the slingshot-like skill game device 100 includes light sources 38 in compartment 32, whereas the slingshot-like skill game device 10 may include battery 36 or some other desired object in compartment 32. As with the slingshot-like skill game device 10, in this embodiment the compartment 32 is positioned on the back surface 12B of the body 12, proximate the opening 16. The compartment 32 may be positioned elsewhere on the body 12. In this embodiment, three light sources 38 are employed; however, more or less light sources 38 may be used, as desired. Preferably, the light sources 38 consist of LEDs or the like. As with the slingshot-like skill game device 10, the object for a user of the slingshot-like skill game device 100 would be for the user to grasp the handle 14 with one hand, grasp the ball 40 (shown in FIG. 9) with the user's other hand, pull the ball 40 away from the body 12, and then release the ball 40 in an attempt to get the ball 40 to pass through opening 16 upon release. In this embodiment, when the user is successful in getting the ball 40 to pass through opening 16, the light sources 38 are activated. Preferably, the light sources 38 are coupled to a sensing means (not shown) in order to activate the light sources 38 when a user of the slingshot-like skill game device 100 is successful in getting the ball 40 to pass through opening 16. The sensing means may be, for example, photoelectric, light sensitive, or some other type of desired sensing means. In a preferred embodiment, activation of the light sources 38 may be accomplished when the sensing means (not shown) reads a change in light conditions and/or a break in a sensor path, which may be caused by the ball 40 passing through opening 16. In a preferred embodiment, the light sources 38 flash from side to side in a wavelike pattern when activated. The light sources 38 may also be illuminated in any number of different ways when activated, as desired.

While the invention has been particularly shown and described with reference to preferred embodiments thereof, it will be understood by those skilled in the art that the foregoing and other changes in form and details may be made therein without departing from the spirit and scope of the invention.

The invention claimed is:

1. A slingshot-like skill game device comprising, in combination:

a body having a front surface and a back surface;

a handle coupled to the body;

a ball;

an elongated elastic cord having a first end and a second end, wherein the first end is adapted to be secured to the body and the second end is attached to the ball, wherein the back surface of the body includes a slot adapted to receive the first end of the elongated elastic cord;

an opening with a diameter larger than the ball in the body adapted for the ball to pass therethrough; and a substantially ring-shaped insert adapted to be removably attached to the opening, wherein the substantially ring-shaped insert decreases the diameter of the opening.

2. The device of claim 1, further comprising a second opening in the body adapted for running the first end of the elongated elastic cord therethrough.

3. The device of claim 1, wherein a diameter of the opening is slightly greater than the interior diameter of the insert.

4. The device of claim 1, further comprising a plurality of substantially ring-shaped inserts having progressively decreasing interior diameters, wherein the inserts are adapted to be removably attached to the opening.

5. The device of claim 1, further comprising an attachment ring positioned on the back surface of the body and adapted to permit the insert to be attached thereto.

6. The device of claim 1, further comprising at least one light source coupled to a sensor the body, wherein the sensor senses the ball passing through the opening thereby activating the light source.

7. The device of claim 1, wherein the back surface includes a storage compartment with a door, wherein the storage compartment is used for storing at least one battery or the elongated elastic cord.

8. A slingshot-like skill game device comprising, in combination:

a body having a front surface and a back surface;

a handle coupled to the body;

a ball;

an elongated elastic cord having a first end and a second end, wherein the first end is adapted to be secured to the body and the second end is attached to the ball;

a first opening in the body adapted for the ball to pass therethrough;

a second opening in the body adapted for running the first end of the elongated elastic cord therethrough;

a slot positioned on the back surface of the body, wherein the slot is adapted to receive the first end of the elongated elastic cord; and a substantially ring-shaped insert adapted to be removably attached to the first opening, wherein an interior diameter of the insert is slightly less than the diameter of the first opening, wherein the inserts may be stored on the slingshot-like skill game device.

9. The device of claim 8 further comprising a plurality of substantially ring-shaped inserts having progressively decreasing interior diameters, wherein the inserts are adapted to be removably attached to the first opening.

10. The device of claim 8 further comprising an attachment ring positioned on the back surface of the body and adapted to permit the ring-shaped insert to be attached thereto.

11. The device of claim 8 further comprising at least one light source coupled to a sensor on the body, wherein the sensor senses the ball passing through the opening thereby activating the light source.

12. The device of claim 8 wherein the back surface includes a storage compartment with a door, wherein the storage compartment is used for storing at least one battery or the elongated elastic cord.

* * * * *